US008116656B2

(12) United States Patent
Furuya

(10) Patent No.: US 8,116,656 B2
(45) Date of Patent: Feb. 14, 2012

(54) IMAGE FORMING APPARATUS WITH GUIDING PORTION FOR CHANGING THE POSITION OF A CLEANING UNIT IN A TRANSFER UNIT

(75) Inventor: Emi Furuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 562 days.

(21) Appl. No.: 12/331,886

(22) Filed: Dec. 10, 2008

(65) Prior Publication Data

US 2009/0154957 A1 Jun. 18, 2009

(30) Foreign Application Priority Data

Dec. 14, 2007 (JP) ..... 2007-322773

(51) Int. Cl.
*G03G 15/16* (2006.01)

(52) U.S. Cl. ..... 399/101; 399/121; 399/123

(58) Field of Classification Search ..... 399/101, 399/121, 123, 308
See application file for complete search history.

(56) References Cited

U.S. PATENT DOCUMENTS

| | | | | |
|---|---|---|---|---|
| 5,587,769 | A * | 12/1996 | Sawada et al. | 399/113 |
| 6,463,236 | B2 * | 10/2002 | Morikami et al. | 399/121 |
| 6,704,528 | B1 | 3/2004 | Kawamura et al. | 399/123 |
| 7,020,415 | B2 * | 3/2006 | Abe | 399/110 |
| 2005/0078991 | A1 * | 4/2005 | Kimura et al. | 399/350 |
| 2007/0147876 | A1 * | 6/2007 | Moro et al. | 399/101 |
| 2007/0196125 | A1 * | 8/2007 | Koizumi et al. | 399/101 |

FOREIGN PATENT DOCUMENTS

| | | |
|---|---|---|
| JP | 2000-330357 | 11/2000 |
| JP | 2001-75374 | 3/2001 |
| JP | 2002-365932 | 12/2002 |
| JP | 2003-98936 | 4/2003 |
| JP | 2007-94251 | 4/2007 |

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

A transfer unit has a belt unit having a belt and a cleaning unit for cleaning the belt. The belt unit and the cleaning unit are integratedly provided. The cleaning unit is movable for the belt unit. The transfer unit is detachable for an apparatus main body. A position of the cleaning unit for the belt unit before the transfer unit is attached to the apparatus main body is different from a position of the cleaning unit for the belt unit after the transfer unit is attached to the apparatus main body.

5 Claims, 10 Drawing Sheets

IMAGE FORMING APPARATUS WITH GUIDING PORTION FOR CHANGING THE POSITION OF A CLEANING UNIT IN A TRANSFER UNIT

BACKGROUND OF THE INVENTION

1. Field of the Invention

The present invention relates to an image forming apparatus such as copying apparatus or laser beam printer (LBP) and, more particularly, to an image forming apparatus in which a transfer unit having a belt and a cleaning device is detachable for an apparatus main body.

2. Description of the Related Art

Hitherto, there has been known a color image forming apparatus in which toner images formed on photosensitive drums of a plurality of process cartridges are primarily transferred onto an intermediate transfer belt in each primary transfer unit and the toner images on the intermediate transfer belt are secondarily transferred onto a recording material in a secondary transfer unit.

In such an image forming apparatus, toner remaining on the intermediate transfer belt after the secondary transfer is removed by a cleaning device and collected into a drain toner collecting tank. Japanese Application Laid-Open No. 2001-075374 has proposed such a technique that the cleaning device and the intermediate transfer belt are integrated as an intermediate transfer unit so as to be detachable for the image forming apparatus main body. Thus, the drain toner can be collected without any leakage and the maintenance operation such as repair, inspection, and exchange of the intermediate transfer belt, and cleaning device can be easily executed.

An image forming apparatus having such an intermediate transfer unit is illustrated in FIGS. 10 and 11. As illustrated in FIG. 10, an intermediate transfer unit 50 is arranged from one side of an image forming apparatus main body to the other side. In the intermediate transfer unit 50, a plurality of process cartridges 53 is arranged under an intermediate transfer belt 51. Further, in the intermediate transfer unit 50, a cleaning device 52 is integratedly fixed to one end portion of the intermediate transfer belt 51 so as to be juxtaposed with the process cartridge 53. On the side (left side of the apparatus main body in the diagram) where the cleaning device 52 has been arranged, as illustrated in FIG. 11, an opening portion 54 is formed so that the intermediate transfer unit 50 can be pulled out. An opening/closing member 55 for covering the opening portion 54 is provided so that it can be freely opened and closed. Thus, the intermediate transfer unit 50 can be pulled out in the horizontal direction from the cleaning device 52 side.

SUMMARY OF THE INVENTION

In the image forming apparatus illustrated in FIGS. 10 and 11, however, the intermediate transfer unit 50 is integratedly fixed to the intermediate transfer belt 51 in a state where the cleaning device 52 is bent. Therefore, in the case of pulling out the intermediate transfer unit 50 from the apparatus main body, it can be pulled out only from the cleaning device 52 side so as not to be interfered with the process cartridges 53. That is, as for the intermediate transfer unit 50 in which two units are integrated, to the intermediate transfer belt 51 as one unit, when a layout of the cleaning device 52 as the other unit is determined, a layout of the opening portion 54 adapted to pull out the cleaning device 52 is also unconditionally decided. Therefore, a degree of freedom of design is limited by the layout of the cleaning device 52.

It is an object of the invention to provide an image forming apparatus which can improve a degree of freedom of design without limiting an attaching/removing direction of a transfer unit in which a belt and a cleaning device have been integrated.

Another object of the invention is to provide an image forming apparatus comprising a transfer unit configured to transfer a toner image on an image bearing member onto a recording material, wherein the transfer unit has a belt unit having a belt and a cleaning unit for cleaning the belt, the belt unit and the cleaning unit are integratedly provided, and the cleaning unit is movable for the belt unit, and wherein the transfer unit is detachable for an apparatus main body and a position of the cleaning unit for the belt unit before the transfer unit is attached to the apparatus main body is different from a position of the cleaning unit for the belt unit after the transfer unit is attached to the apparatus main body.

Further features of the present invention will become apparent from the following description of exemplary embodiments with reference to the attached drawings.

DESCRIPTION OF THE EMBODIMENTS

Figure 1:
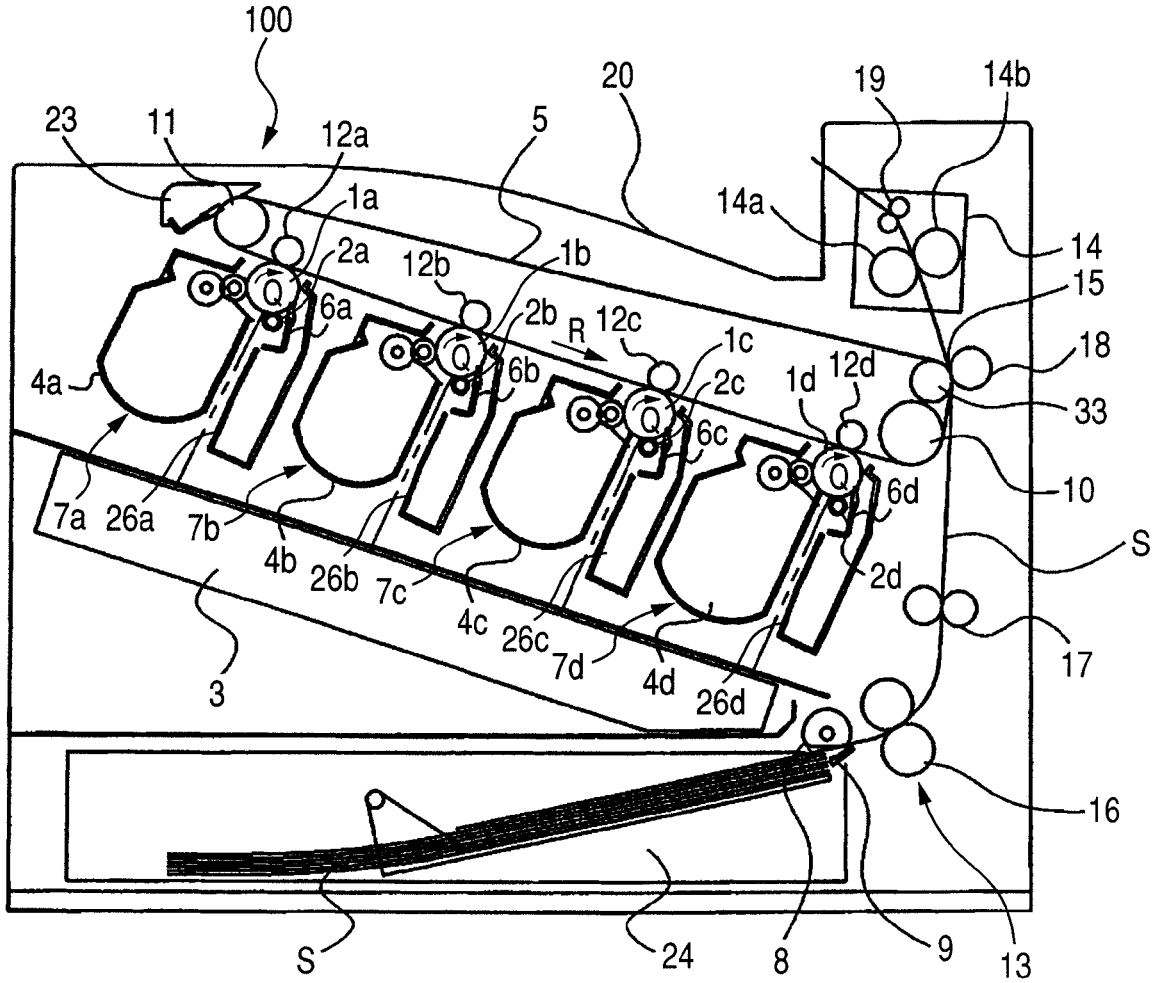
FIG. 1 is a diagram illustrating an image forming apparatus according to an embodiment of the invention.

An exemplary embodiment of the invention will be illustratively described in detail hereinbelow with reference to the drawings. It should be noted that dimensions, materials, and shapes of component elements their relative layouts disclosed in the following embodiments, are properly modified depending on a construction of an apparatus to which the invention is applied and various kinds of conditions. Therefore, the scopes of the invention are not limited to them unless otherwise specified.

An image forming apparatus will now be described with reference to FIGS. 1 to 9. First, a whole construction of the image forming apparatus will be described hereinbelow with reference to FIG. 1. Subsequently, a construction of a primary transfer unit will be described with reference to FIGS. 2 to 5. Then, the attaching operation of the primary transfer unit to the apparatus main body will be described with reference to FIGS. 6 and 7. Finally, positioning of the primary transfer unit to the apparatus main body will be described with reference to FIGS. 7 to 9.

First, the whole construction of the image forming apparatus will be described with reference to FIG. 1. An image forming apparatus 100 illustrated in FIG. 1 has four process cartridges which are juxtaposed so as to be inclined from the horizontal direction. Each process cartridge 7 (7*a* to 7*d*) has one electrophotographic photosensitive drum 1 (1*a* to 1*d*) as an image holding material.

The electrophotographic photosensitive drum (hereinbelow, referred to as a "photosensitive drum") 1 is rotated clockwise in FIG. 1 by a driving member (not shown). The following process devices 2, 3, 4, 5, and 6 which act on the photosensitive drum are provided in order around the photosensitive drum 1 in order along its rotating direction. That is, a charging roller 2 (2*a* to 2*d*) for uniformly charging the surface of the photosensitive drum 1, a developing unit 4 (4*a* to 4*d*) for developing an electrostatic latent image by using toner as a developer (hereinbelow, referred to as "toner"), and a cleaning member 6 (6*a* to 6*d*) for removing the toner remaining on the surface of the photosensitive drum 1 after the transfer are arranged. A scanner unit 3 for forming the electrostatic latent image onto the photosensitive drum 1 by irradiating a laser beam based on image information and an intermediate transfer belt 5 onto which a toner image on the photosensitive drum 1 is transferred are also arranged. The photosensitive drum 1, charging roller 2, developing unit 4, and cleaning member 6 are integratedly assembled as a cartridge, thereby forming the process cartridge 7 which is detachable for an attaching portion of the image forming apparatus.

The intermediate transfer belt 5 is stretched around a driving roller 10, a tension roller 11, and a secondary transfer facing roller 33. A primary transfer roller 12 (12*a* to 12*d*) is arranged inside of the intermediate transfer belt 5 so as to face each photosensitive drum 1 (1*a* to 1*d*). A transfer bias is applied to the primary transfer roller 12 by a bias applying device (not shown).

When each photosensitive drum 1 rotates in the direction shown by an arrow Q, the intermediate transfer belt 5 rotates in the direction shown by an arrow R, and further, a bias of a positive polarity is applied to the primary transfer roller 12, the toner image formed on the photosensitive drum 1 is sequentially transferred (primary transfer) onto the intermediate transfer belt 5. In a state where the toner images of four colors are overlaid onto the intermediate transfer belt 5, they are conveyed to a secondary transfer unit 15.

The toner remaining on the surface of the photosensitive drum 1 after the toner image was transferred is removed by the cleaning member 6. The removed toner is collected into a removal toner room in a photosensitive material unit (unit in which the photosensitive material, charging roller, and cleaning member have been integrated) 26 (26*a* to 26*d*).

Synchronously with the image forming operation, a sheet S as a recording material is conveyed by a conveying device constructed by a feeding apparatus 13, and a registration roller pair 17. The feeding apparatus 13 has: a feeding cassette 24 for enclosing the sheets S; a feeding roller 8 for feeding the sheet S; and a conveying roller pair 16 for conveying the fed sheet S. The feeding cassette 24 can be pulled out in the direction on this side of the apparatus in FIG. 1. After the user pulled out the feeding cassette 24 and removed it from the apparatus main body, he sets the sheets S into the feeding cassette and inserts the feeding cassette into the apparatus main body, so that a sheet supplement is completed. The sheets S enclosed in the feeding cassette 24 are come into pressure contact with the feeding roller 8, separated one by one by a separating pad 9 (frictional member separation system), and conveyed by the conveying roller pair 16.

The sheet S conveyed from the feeding apparatus 13 is conveyed to the secondary transfer unit 15 by the registration roller pair 17. In the secondary transfer unit 15, by applying a bias of a positive polarity to a secondary transfer roller 18, the toner images of the four colors on the intermediate transfer belt 5 are transferred (secondary transfer) onto the conveyed sheet S.

The toner remaining on the intermediate transfer belt 5 after the secondary transfer onto the sheet S is removed by a transfer belt cleaning device 23 as a cleaning device. The removed toner passes through a drain toner conveying path (not shown) and is collected into a drain toner collecting tank (not shown) arranged on the rear side of the apparatus (rear side in the direction perpendicular to the sheet surface of FIG. 1).

A fixing unit 14 as a fixing device applies a heat and a pressure to the toner image formed on the sheet S, thereby fixing it. A fixing belt 14*a* has a cylindrical shape and is guided to a belt guiding member (not shown) to which a heat generating device such as a heater has been attached. The belt guiding member and a pressing roller 14*b* form a fixing nip with a predetermined pressure contact force through the fixing belt 14*a*.

An image forming unit forms an unfixed toner image onto the sheet S. The sheet S conveyed from the image forming unit is heated and pressed in the fixing nip between the fixing belt 14*a* and the pressing roller 14*b*, thereby fixing the unfixed toner image on the sheet S. After that, the fixed sheet S is ejected onto an ejecting tray 20 by an ejecting roller pair 19.

Figure 2:
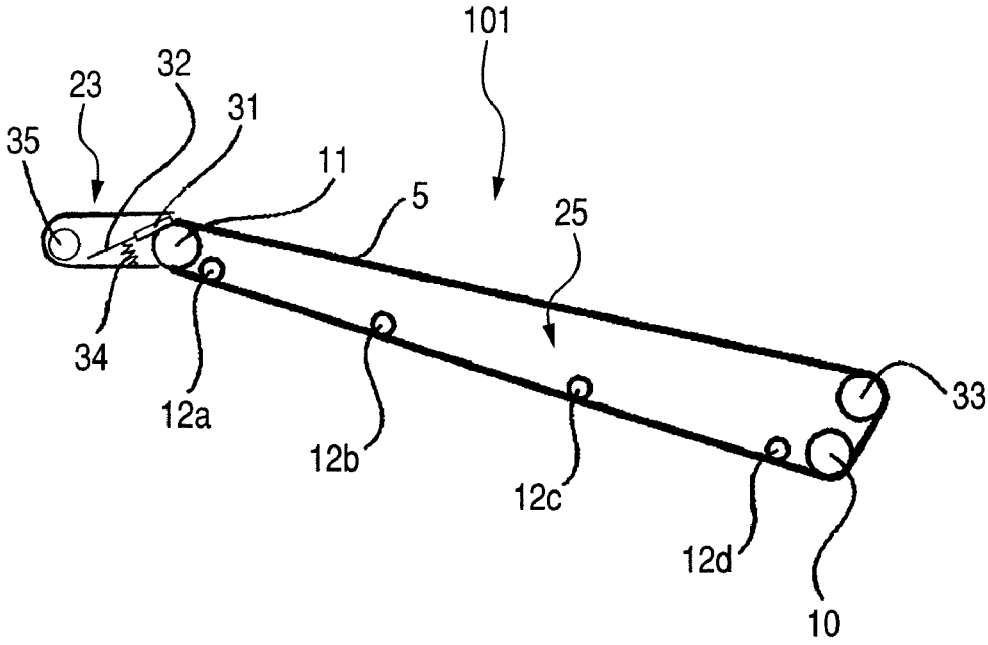
FIG. 2 is a cross sectional view of an intermediate transfer unit.
Figure 3:
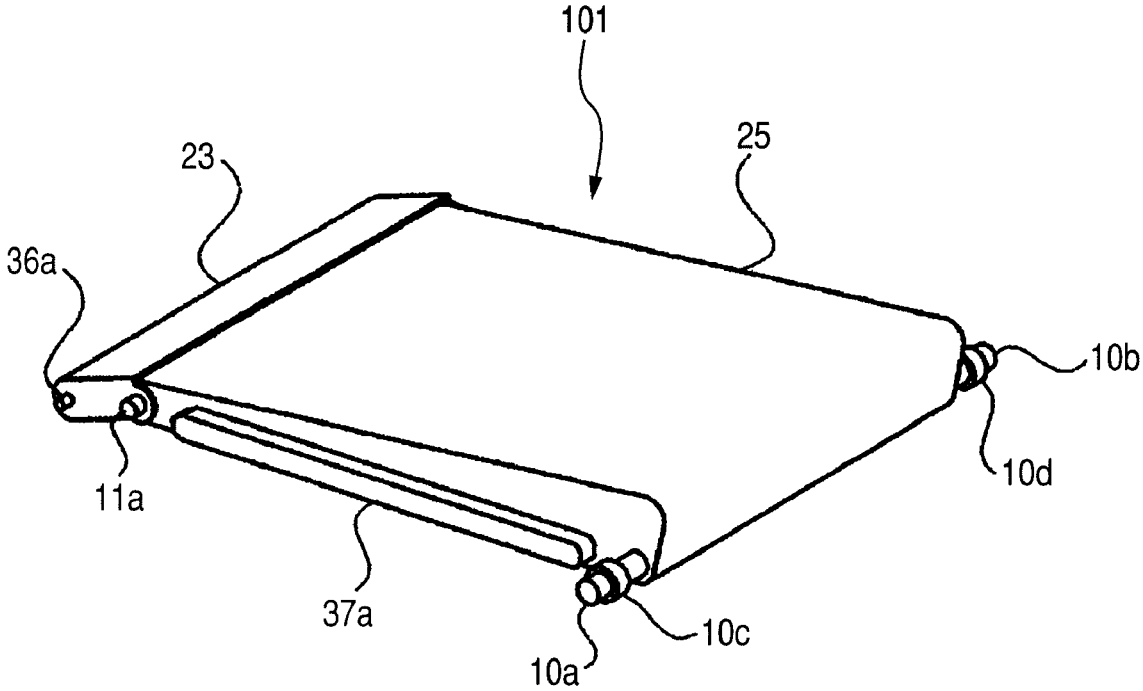
FIG. 3 is a perspective view of the intermediate transfer unit.
Figure 4:
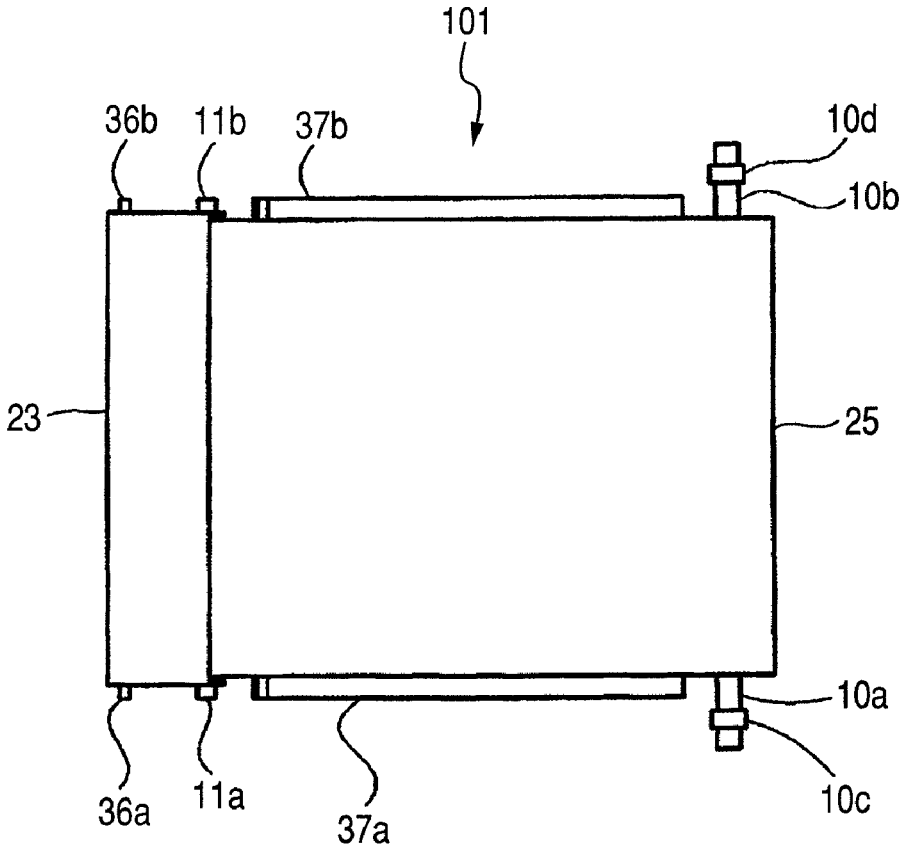
FIG. 4 is a plan view of the intermediate transfer unit.
Figure 5:
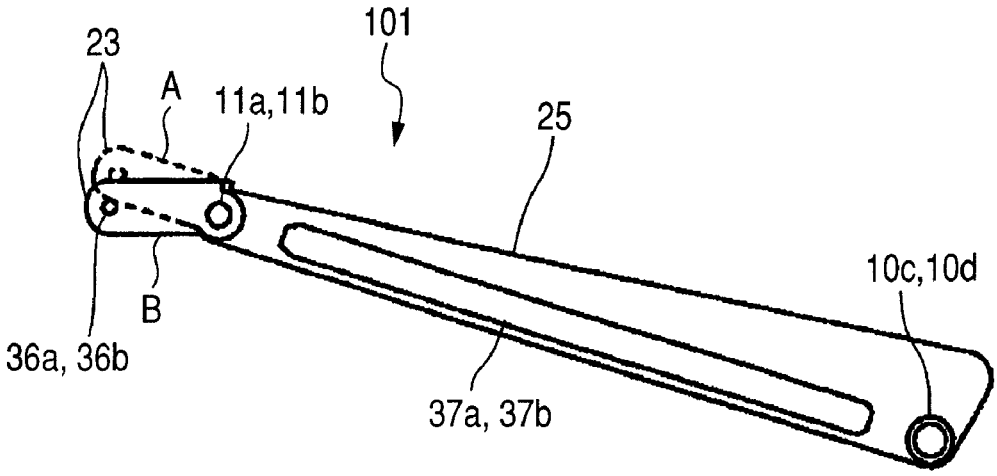
FIG. 5 is a front view of the intermediate transfer unit.

Subsequently, a construction of an intermediate transfer unit 101 as a transfer unit will be described with reference to FIGS. 2 to 5. FIG. 2 is a schematic cross sectional view of the intermediate transfer unit 101. FIG. 3 is a perspective view of the intermediate transfer unit 101. FIG. 4 is a plan view of the intermediate transfer unit 101. FIG. 5 is a front view of the intermediate transfer unit 101.

The intermediate transfer unit 101 is a detachable unit in which a transfer belt unit (hereinbelow, referred to as a belt unit) 25 serving as a first unit and the transfer belt cleaning device (hereinbelow, referred to as a cleaning unit) 23 serving as a second unit which is come into contact with the belt unit 25 and acts thereon have integratedly been provided. The intermediate transfer unit 101 is detachably attached to the image forming apparatus main body. The intermediate transfer unit is a unit for transferring the toner image on the photosensitive drum onto the sheet.

The belt unit 25 has the intermediate transfer belt 5 as an endless belt suspended by the driving roller 10, tension roller 11, and secondary transfer facing roller 33 serving as a plurality of stretching members. The belt unit 25 further has the four primary transfer rollers 12 (12*a* to 12*d*) provided at the positions which face the photosensitive drums 1 through the belt 5.

As illustrated in FIG. 2, the cleaning unit 23 has a cleaning blade 31 as a cleaning member which is come into contact with the intermediate transfer belt 5 and scrapes off the remaining toner on the intermediate transfer belt 5. The cleaning unit 23 also has: a cleaning blade supporting plate 32 for holding a position of the cleaning blade 31; and a blade pressing spring 34 for pressing the cleaning blade 31 onto the intermediate transfer belt 5. The cleaning unit 23 further has a screw 35 for feeding the remaining toner scraped from the intermediate transfer belt 5 to the collecting tank.

The cleaning unit 23 is provided so that it can swing for the belt unit 25 around an axial line, as a center, in the direction which perpendicularly crosses the inserting direction of the intermediate transfer unit 101. Specifically speaking, as illustrated in FIGS. 3 and 4, the cleaning unit 23 is supported so that it can swing for the belt unit 25 while axes 11*a* and 11*b* of the tension roller 11 are used as fulcrums. That is, a swing center of the cleaning unit and the axes of the tension roller are located on the same line. The cleaning unit 23 swings around the axes 11*a* and 11*b*, as a center, serving as a rotational center of the tension roller 11 which is locating on the rearmost side in the inserting direction of the intermediate transfer unit among a plurality of stretching members held by the belt unit 25. In this manner, the cleaning unit 23 can move for the belt unit 25. As illustrated in FIG. 5, the position of the cleaning unit 23 for the belt unit 25 before it is attached into the image forming apparatus main body and that when the attachment is completed (after the attachment was completed) are different. As for the position of the cleaning unit 23 for the belt unit 25, the position shown by a broken line in FIG. 5 is a first position A at the time of the insertion start (before the attachment) and the position shown by a solid line in FIG. 5 is a second position B at the time of the attachment completion (after the attachment).

As illustrated in FIG. 4, positioning bosses 36*a* and 36*b* for positioning the position of the cleaning unit 23 when it is attached into the apparatus main body 100 are provided for the cleaning unit 23. Guide portions (portions to be guided) 37*a* and 37*b* at the time when the intermediate transfer unit 101 is attached into the apparatus main body 100 are provided for the belt unit 25. In FIG. 4, driving roller axes 10*a* and 10*b* are provided and driving roller bearings 10*c* and 10*d* are attached to the driving roller axes. The positioning bosses 36*a* and 36*b* of the cleaning unit 23, the guide portions 37*a* and 37*b* of the intermediate transfer unit 101, and the tension roller axes 11*a* and 11*b* are guide members which are guided by guiding members in the apparatus main body, which will be described hereinafter. Those guide members are respectively provided on both sides in the direction which perpendicularly crosses the inserting direction of the intermediate transfer unit 101.

Figure 6:
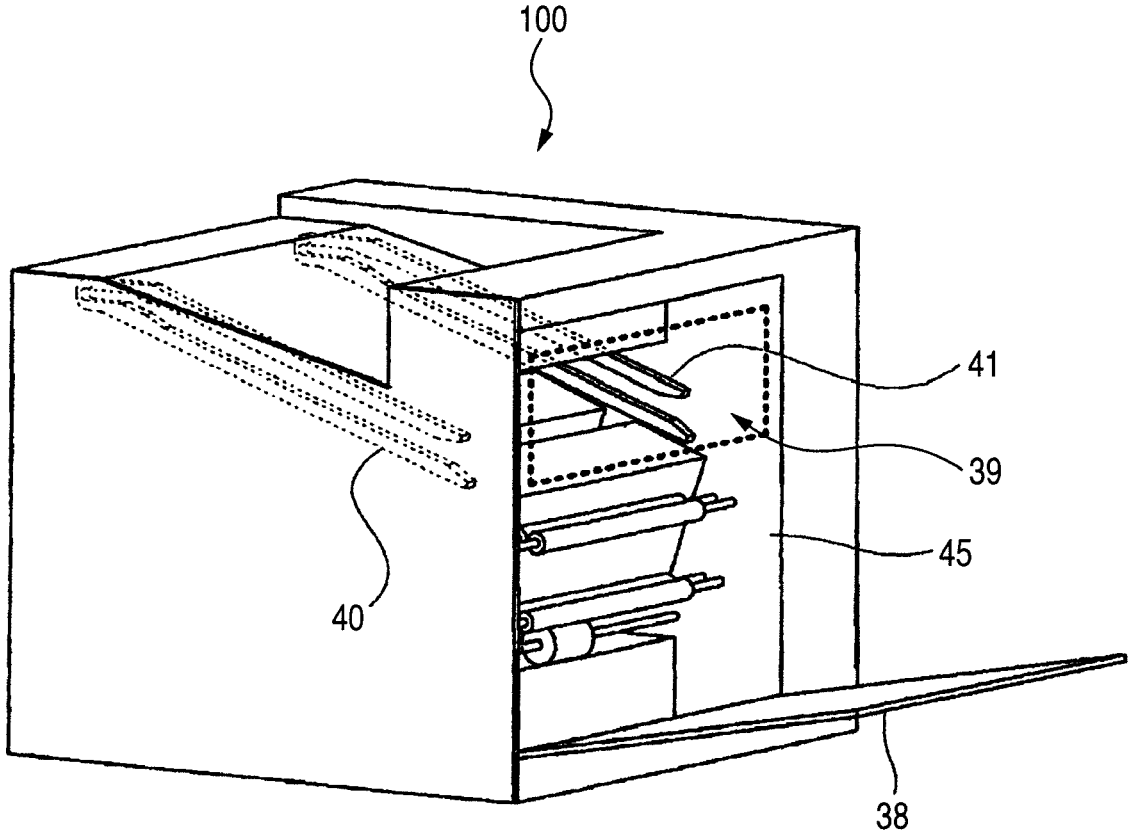
FIG. 6 is a diagram illustrating an attaching portion of the intermediate transfer unit.
Figure 7:
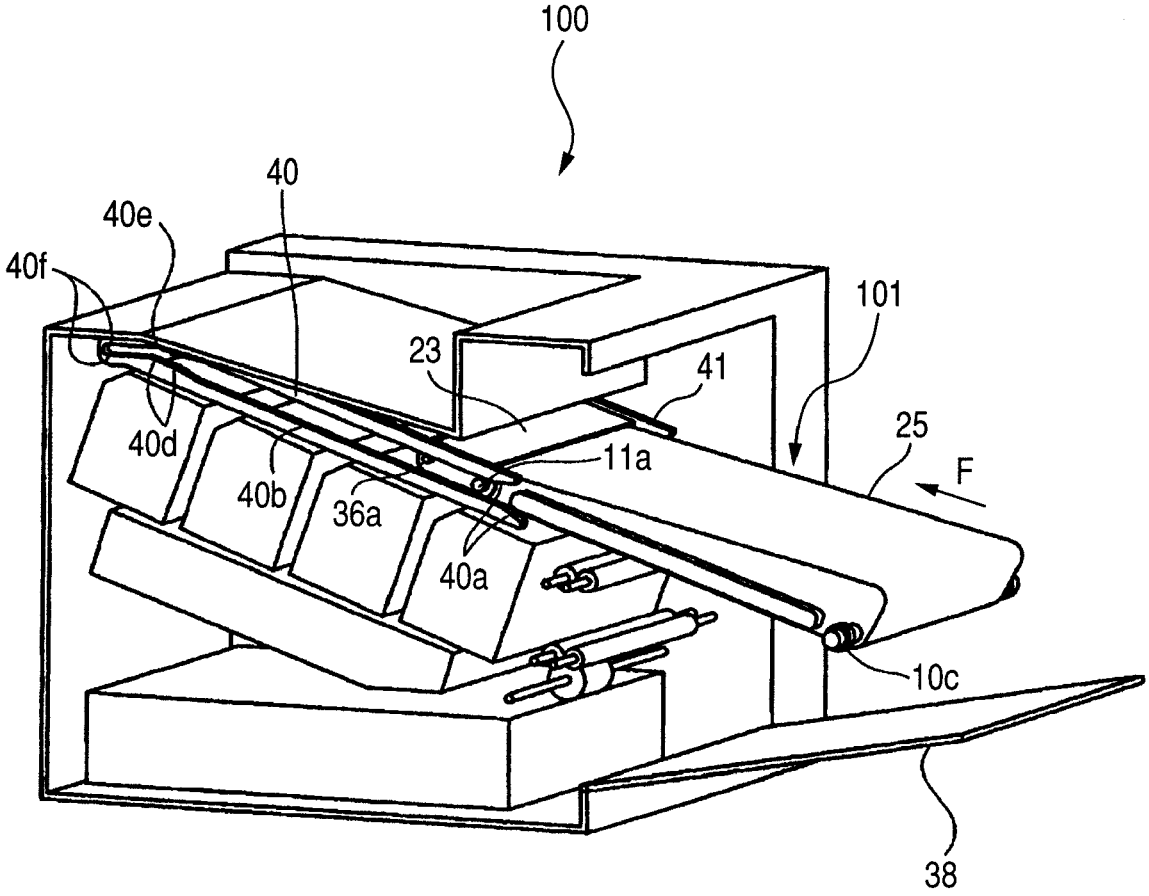
FIG. 7 is a diagram illustrating the attaching operation of the intermediate transfer unit.

Subsequently, the attaching operation in the case of attaching the intermediate transfer unit 101 into the apparatus main body 100 will be described with reference to FIGS. 6 and 7. FIG. 6 is a perspective view illustrating an attaching portion for attaching the intermediate transfer unit 101 into the apparatus main body 100. FIG. 7 is a perspective view illustrating a state where the intermediate transfer unit 101 is attached into the apparatus main body 100.

The intermediate transfer unit 101 is constructed so as to be detachable for the apparatus main body 100. By using such a construction, for example, the maintenance operation such as repair, inspection, and exchange of the intermediate transfer belt 5, or cleaning unit 23 can be easily executed. Thus, using efficiency of the apparatus main body 100 can be improved.

In order to reduce a dimension in the horizontal direction of the apparatus main body 100 and miniaturize the apparatus main body 100, the process cartridges 7 are arranged in the oblique direction for the horizontal direction as illustrated in FIG. 7. The intermediate transfer unit 101 is also arranged in the oblique direction for the horizontal direction according to the layout of the process cartridges 7.

The attaching direction of the intermediate transfer unit 101 to the apparatus main body 100 is a direction of an arrow F shown in FIG. 7. A description will be made hereinbelow on the assumption that the right side of the apparatus main body 100 illustrated in FIG. 1 is referred to as this side in the attaching direction of the intermediate transfer unit and the left side is referred to as a rear side in the attaching direction.

As illustrated in FIGS. 6 and 7, the image forming apparatus 100 closably has an opening/closing member 38 which covers an opening portion 45 adapted to insert the intermediate transfer unit 101 into the apparatus main body 100.

When the intermediate transfer unit 101 is attached into the apparatus main body 100, first, the opening/closing member 38 is opened. Although not shown, the secondary transfer roller 18 is provided for the opening/closing member 38 and moves together with the opening/closing member 38. The opening/closing member 38 forms a portion of an external surface of the apparatus main body 100. When the opening/closing member 38 is opened, the sheet S which has been jammed during the conveyance can be also removed from the opened opening portion 45 and the fixing unit can be also attached/removed. Although the opening/closing direction of the opening/closing member 38 has been set in such a direction that the opening/closing member 38 can be opened/closed in the vertical direction, it can be also set so that the opening/closing member 38 can be opened/closed in the horizontal direction.

When the opening/closing member 38 is opened, an attaching portion 39 of the intermediate transfer unit 101 which is attached into the apparatus main body 100 is exposed to the inside of the apparatus main body 100 together with a conveying path of the sheet S and the registration roller pair 17.

As illustrated in FIG. 6, attaching guides 40 and 41 extending in the upper oblique direction from the right side to the left side of the apparatus main body 100 in FIG. 1 are provided on this side and the rear side of the attaching portion 39 in the apparatus main body 100, respectively. The attaching guides 40 and 41 are guiding members for guiding the intermediate transfer unit 101 inserted into the attaching portion 39 from the opening portion 45.

While the positioning bosses 36*a* and 36*b*, tension roller axes 11*a* and 11*b*, and guide portions 37*a* and 37*b* of the intermediate transfer unit 101 are being guided in order by the attaching guides 40 and 41 on this side and the rear side of the apparatus, the intermediate transfer unit 101 is inserted in the direction shown by the arrow F. After the intermediate transfer unit 101 was inserted to a predetermined inserting position in the apparatus main body 100, the opening/closing member 38 is closed and the attachment of the intermediate transfer unit 101 is completed.

Subsequently, the positioning of the intermediate transfer unit 101 to the apparatus main body 100 will be described further in detail with reference to FIGS. 7 to 9.

The positioning on the apparatus this-side of the intermediate transfer unit 101 to the attaching guide 40 on this side of the apparatus main body 100 will be described hereinbelow. The attaching guide 41 and the guide member having shapes which are symmetrical to those on this side of the apparatus are also provided on the apparatus rear-side of the apparatus main body 100 and the intermediate transfer unit 101, respectively. The intermediate transfer unit 101 is attached without causing an inclination on this side and the rear side of the apparatus main body.

Before the intermediate transfer unit 101 is attached, the cleaning unit 23 has been pressed to the belt unit 25 by an urging member (spring) so as to keep the first position on such an almost straight line that a unit lower surface becomes substantially a flat plane as illustrated in FIGS. 5 and 7.

Figure 8:
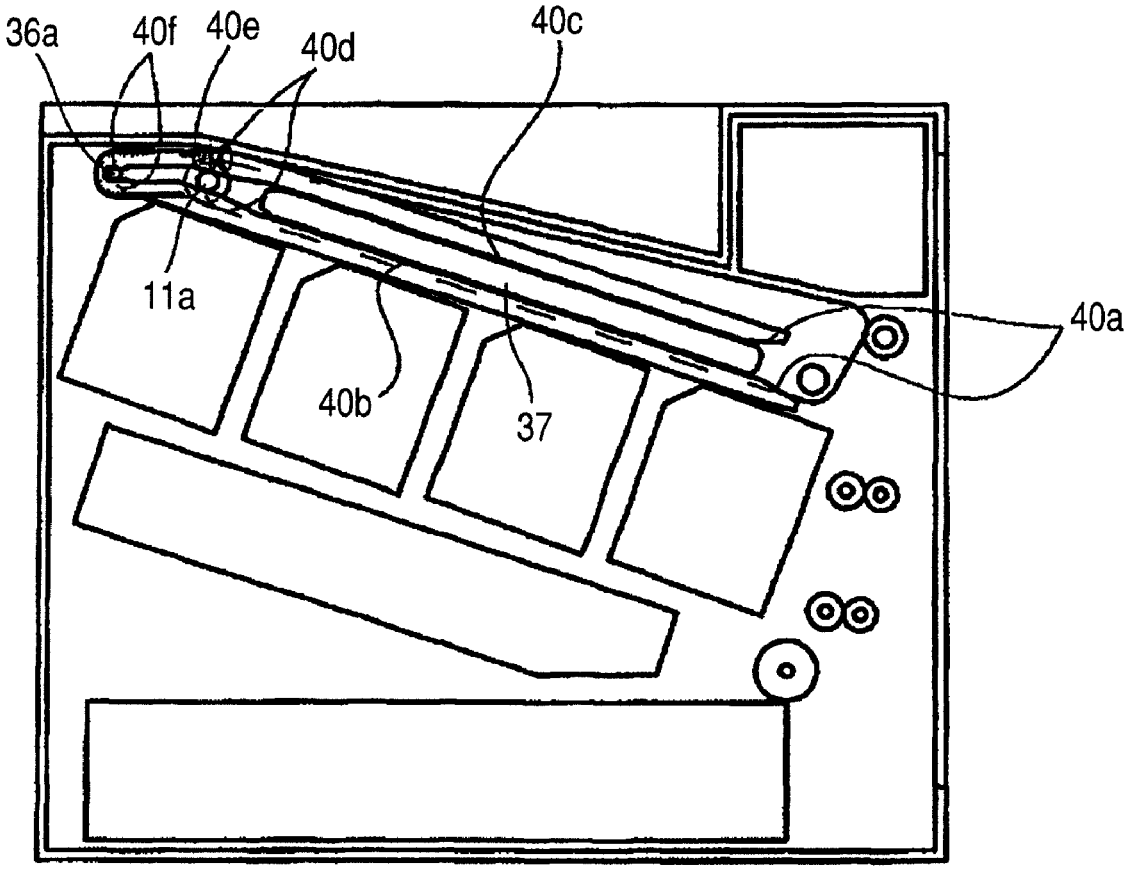
FIG. 8 is a diagram illustrating an attachment completion state of the intermediate transfer unit.

As illustrated in FIG. 8, the attaching guide 40 provided for the attaching portion 39 in the apparatus main body 100 has a first guiding portion 40*b*, a second guiding portion 40*d*, and a third guiding portion 40*f* in order from the upstream side toward the downstream side in the inserting direction. Those three guiding portions are formed in such a manner that a width at which the attaching guide 40 sandwiches each guide member is narrowed step by step toward the downstream side in the inserting direction. Among them, the second guiding portion 40*d* has a width narrower than that of the first guiding portion 40*b* and has a width adapted to fit the tension roller axis 11*a*. The third guiding portion 40*f* has a width narrower than that of the second guiding portion 40*d* and has a width adapted to fit the positioning boss 36*a*.

When the intermediate transfer unit 101 is attached into the apparatus main body 100, as illustrated in FIG. 7, first, the positioning boss 36*a* of the cleaning unit 23 is aligned with an inlet portion 40*a* of the attaching guide 40. When the intermediate transfer unit 101 is inserted in the direction of the arrow F while allowing the positioning boss 36*a* to be moved along the lower side surface of the first guiding portion 40*b* of the attaching guide 40, the tension roller axis 11*a* is subsequently guided by the first guiding portion 40*b* of the attaching guide 40. When the intermediate transfer unit 101 is further pressed in the direction of the arrow F, the guide portion 37*a* of the belt unit 25 is guided by the first guiding portion 40*b* of the attaching guide 40.

When the intermediate transfer unit 101 is continuously pressed in the direction of the arrow F, the positioning boss 36*a* of the cleaning unit 23 reaches a bending portion 40*e* of the second guiding portion 40*d* of the attaching guide 40. After that, as illustrated in FIG. 8, the positioning boss 36*a* is guided by the second guiding portion 40*d* of the attaching guide 40. The cleaning unit 23 swings gradually around the tension roller axis 11*a* as a center and starts to change the position.

Figure 9:
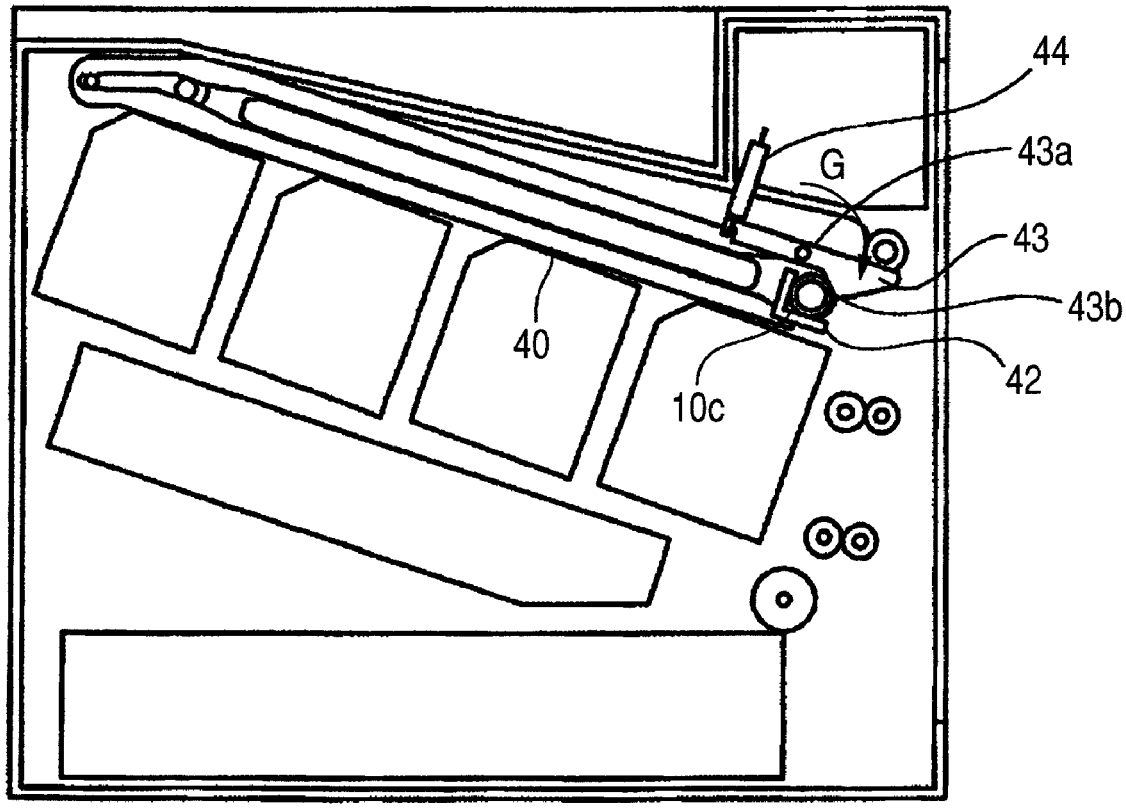
FIG. 9 is a diagram illustrating a locking state of the intermediate transfer unit.
Figure 10:
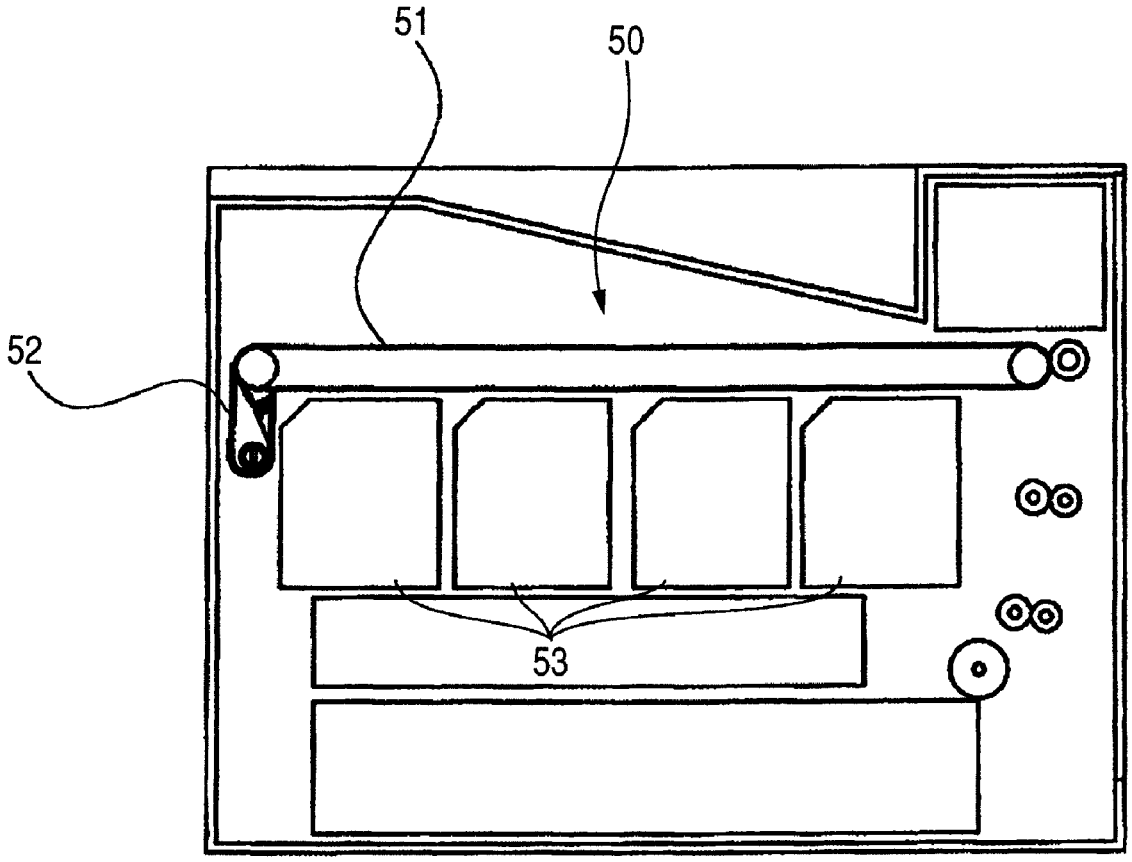
FIG. 10 is a cross sectional view of an image forming apparatus in the related art.
Figure 11:
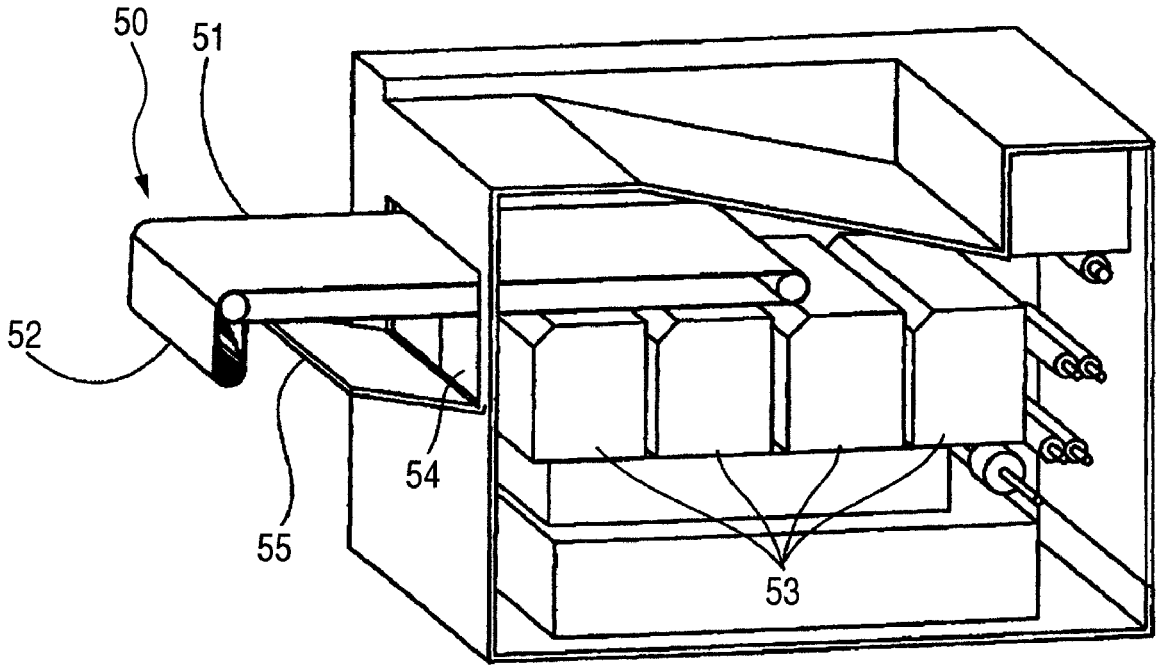
FIG. 11 is a perspective view of the image forming apparatus in the related art.

Just before the intermediate transfer unit 101 is completely attached into the apparatus main body 100, as illustrated in FIG. 9, the driving roller bearing 10*c* attached to the driving roller axis 10*a* reaches the position where it is come into contact with a lock lever 43 provided for the apparatus main body 100.

The lock lever 43 is provided on the side of the apparatus main body 100 and rotates around a rotational center 43*a* as a center. The lock lever 43 is pressed in the direction of an arrow G by a lock lever spring 44 around the rotational center 43*a* as a center.

After the driving roller bearing 10*c* reached the position where it is come into contact with the lock lever 43, when the intermediate transfer unit 101 is further pressed in the direction of the arrow F, the lock lever 43 receives a force from the driving roller bearing 10*c* and retreats while rotating in the direction opposite to the direction of the arrow G. When the driving roller bearing 10*c* passes through a vertex 43*b* of the lock lever 43, the lock lever 43 rotates in the direction of the arrow G by the urging force of the lock lever spring 44 while moving along the driving roller bearing 10*c*.

The intermediate transfer unit 101 stops at a position where the driving roller bearing 10*c* has collided with a positioning portion 42 provided for the apparatus main body 100, and the attachment is completed. While pressing the driving roller bearing 10*c* to the positioning portion 42, the lock lever 43 fixes the intermediate transfer unit 101 to the apparatus main body 100.

At this time, the tension roller axis 11*a* reaches the second guiding portion 40*d* of the attaching guide 40 and is fitted therein in the direction which is almost perpendicular to the attaching direction of the intermediate transfer unit 101. Thus, the position of the belt unit 25 in the intermediate transfer unit 101 is determined. The positioning boss 36*a* of the cleaning unit 23 reaches the third guiding portion 40*f* of the attaching guide 40 and is fitted therein. Thus, the swing of the cleaning unit 23 around the tension roller axis 11*a* as a rotational center is stopped. The cleaning unit 23 finishes the change in position to the second position different from the first position before the attachment and the position is decided as illustrated in FIG. 8. In this manner, the belt unit 25 and the cleaning unit 23 serving as an intermediate transfer unit 101 are positioned to the apparatus main body 100 by the attaching guide 40 (41), respectively.

As mentioned above, the cleaning unit 23 in the intermediate transfer unit 101 is integrated with the belt unit 25 so that it can swing. Thus, in the attaching step, the position of the cleaning unit 23 in the intermediate transfer unit 101 changes along the attaching guides 40 and 41 for the belt unit 25. Therefore, the attaching/removing direction of the intermediate transfer unit 101 and the position of the opening portion are not limited by the layout relation between the two integrated units 23 and 25. Further, the attaching/removing direction of the intermediate transfer unit 101 is not limited by the members such as process cartridges in the apparatus. Thus, a degree of freedom of the design is improved.

By constructing the intermediate transfer unit 101 in which the cleaning unit 23 is integrated with the belt unit 25 so that it can swing, the intermediate transfer unit 101 can be pulled out from the belt unit 25 side. Thus, the opening/closing member 38 of the opening portion adapted to attach/remove the unit can be used both for an opening/closing member for a jam process of the sheet S and an opening/closing member for exchanging the fixing unit.

Although the four process cartridges which are detachable for the image forming apparatus main body have been used in the foregoing embodiment, the number of process cartridges which are used is not limited but may be properly set as necessary. The guiding members are not limited to a rail shape as shown in the foregoing embodiment but may be other members such as projections in the apparatus main body in which the position of the second unit for the first unit is changed.

In the foregoing embodiment, the process cartridge in which the photosensitive drum and the charging device (charging roller 2), the developing device (developing unit 4), and the cleaning device (cleaning member 6) serving as processing devices which act on the photosensitive drum are integratedly provided has been shown as an example. However, the invention is not limited to such an example but a process cartridge integratedly having any one of them besides the photosensitive drum may be used.

Although the printer has been shown as an example of the image forming apparatus in the foregoing embodiment, the invention is not limited to it but may be also applied to another image forming apparatus such as copying apparatus, or facsimile apparatus or another image forming apparatus such as a multifunction apparatus in which their functions are combined.

Although the foregoing embodiment has been shown with respect to the example of the image forming apparatus in which the intermediate transfer belt is used, the toner images of the respective colors are sequentially overlaid and transferred onto the belt, and the toner images held on the belt are transferred onto the recording material in a lump, the invention is not limited to it.

Figure 12:
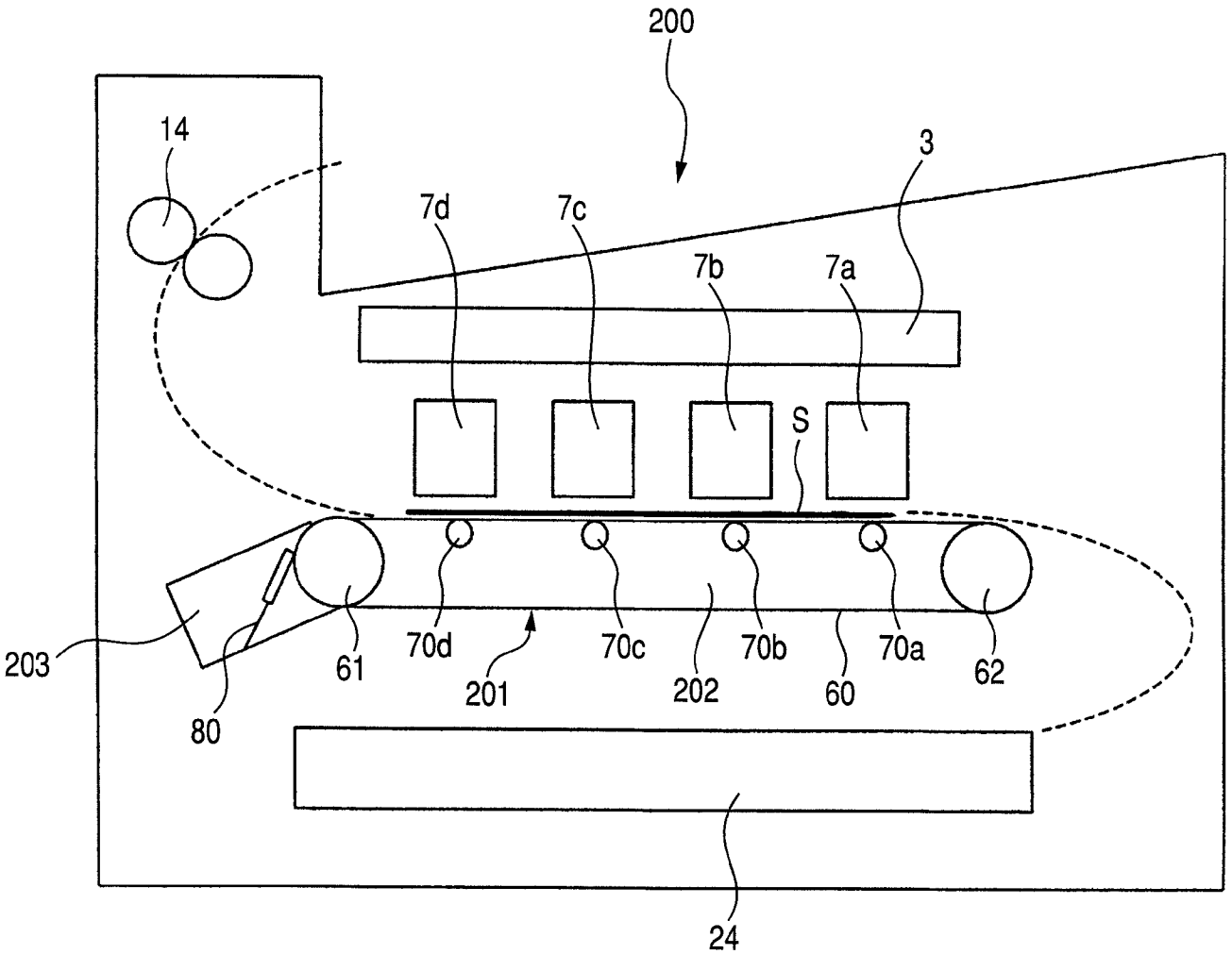
FIG. 12 is a diagram illustrating an image forming apparatus according to another embodiment of the invention.

As illustrated in FIG. 12, an image forming apparatus 200 in which a recording material conveying belt 60 as an endless belt for holding and conveying a recording material is used and toner images of the respective colors are sequentially overlaid and transferred onto the recording material S held on the belt 60 may be used.

That is, a transfer unit 201 integratedly has a belt unit 202 and a cleaning unit 203. The belt unit 202 has the belt 60, a driving roller 61, a tension roller 62, transfer members 70*a*, 70*b*, 70*c*, and 70*d*. The cleaning unit 203 has a cleaning blade

80. The cleaning unit 203 is movable for the belt unit 202. The position of the cleaning unit 203 for the belt unit 202 before the transfer unit 201 is attached to the apparatus main body and that after it was attached to the apparatus main body are different. Similar effects can be obtained even if the invention is applied to those image forming apparatuses.

According to the invention, in the detachable unit, the second unit is integrated with the first unit so that it can swing. In the attaching step, the position of the second unit for the first unit changes along the guiding members. Therefore, the attaching/removing direction of the detachable unit and the position of the opening portion are not limited by the layout relation between the two integrated units. Further, the attaching/removing direction of the detachable unit is not limited either by other members in the apparatus. Consequently, the degree of freedom of the design is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-322773, filed Dec. 14, 2007, which is hereby incorporated by reference herein in its entirety.

What is claimed is:

1. An image forming apparatus comprising:

a transfer unit configured to transfer a toner image on an image bearing member onto a recording material, wherein the transfer unit has a belt unit having a belt and a cleaning unit for cleaning the belt, the belt unit and the cleaning unit being integratedly provided, the cleaning unit is movable for the belt unit, the transfer unit is detachable from an apparatus main body, and a position of the cleaning unit for the belt unit before the transfer unit is attached to the apparatus main body is different from a position of the cleaning unit for the belt unit after the transfer unit is attached to the apparatus main body;

an opening portion formed in the apparatus main body to attach and remove the transfer unit; and a guiding portion for guiding the transfer unit to attach and remove the transfer unit through the opening portion, wherein the cleaning unit is guided by the guiding portion, thereby changing a position of the cleaning unit for the belt unit.

2. An apparatus according to claim 1, wherein the cleaning unit is capable of swinging for the belt unit around an axial line, as a center, in a direction which perpendicularly crosses an attaching/removing direction of the transfer unit.

3. An apparatus according to claim 2, wherein the belt unit has a stretching member to which the belt is stretched and the axial line coincides with a rotational center of the stretching member.

4. An apparatus according to claim 1, wherein the belt is an intermediate transfer belt for directly holding the toner image.

5. An apparatus according to claim 1, wherein the belt is a recording material conveying belt for holding and conveying the recording material.

* * * * *